United States Patent [19]

Noë et al.

[11] Patent Number: 4,464,805

[45] Date of Patent: Aug. 14, 1984

[54] STRIP PICKLING APPARATUS WITH STRAIGHT-THROUGH STRIP TRAVEL

[75] Inventors: Oskar Noë; Andreas Noë, both of Mühlheim an der Ruhr; Rolf Noë, Berlin-Charlottenburg; Heinz W. Berger, Neukirchen-Vluyn, all of Fed. Rep. of Germany

[73] Assignee: BWG Bergwerk- Und Walzwerk-Maschinenbau GmbH, Duisburg, Fed. Rep. of Germany

[21] Appl. No.: 426,066

[22] Filed: Sep. 28, 1982

[30] Foreign Application Priority Data

Mar. 18, 1982 [DE] Fed. Rep. of Germany ..... 3209890

[51] Int. Cl.[3] ..... A47L 1/02; A47L 11/02

[52] U.S. Cl. ..... 15/102; 15/77

[58] Field of Search ..... 15/77, 102; 134/64 R, 134/64 P, 122 R, 122 P, 9, 15; 29/81 R, 81 B, 81 G

[56] References Cited

U.S. PATENT DOCUMENTS

| | | | |
|---|---|---|---|
| 1,888,498 | 11/1932 | Gipe et al. | 15/77 |
| 2,234,593 | 3/1941 | Ferm et al. | 15/102 |
| 2,282,628 | 5/1942 | Whann et al. | 15/77 |
| 2,372,599 | 3/1945 | Nachtman | 15/77 |
| 2,929,088 | 3/1960 | Wier, Jr. | 15/102 |

*Primary Examiner*—Timothy F. Simone

*Attorney, Agent, or Firm*—Karl F. Ross; Herbert Dubno

[57] ABSTRACT

A metal-strip pickling apparatus has feed means including upstream and downstream bridle-roller pairs for longitudinally displacing the strip under longitudinal tension along a straight transport path from the upstream bridle-roller pair to the downstream bridle-roller pair. A housing longitudinally traversed by the strip is subdivided longitudinally by a succession of transverse partitions into a longitudinal succession of compartments each having a respective treatment bath, normally of acid. Each partition has a rigid lower partition half having an upper edge and an upper partition half having a lower edge portion elastically engaging the upper face of the strip moving along the path. The upper edges all are longitudinally aligned and touch the lower face of the strip moving along the path. The acid baths have liquid levels above the upper edges of the respective lower partition halves. The lower portions of the upper partition halves seal tightly with the strip and respective lower partition halves. Thus liquid from one bath cannot pass between the respective partition halves into the next compartment. The use of a straight transport path through the apparatus means that strip tension is irrelevant.

13 Claims, 7 Drawing Figures

STRIP PICKLING APPARATUS WITH STRAIGHT-THROUGH STRIP TRAVEL

FIELD OF THE INVENTION

The present invention relates to the pickling of metal strip, normally steel strip. More particularly this invention concerns an apparatus in which the strip passes through a succession of separate acid baths.

BACKGROUND OF THE INVENTION

In order to clean and partially descale metallic strip, an operation essential with steel strip before finish rolling, it is standard practice to pass the strip through a succession of acid baths. The pickling apparatus therefore normally has upstream and downstream bridle roller pairs that flank an elongated housing and that pull the strip through this housing. Internal weirs, that is walls extending up from the floor of the housing, subdivide this housing into a succession of vessels each of which holds a respective acid bath, normally of Fe—HCl or $H_2SO_4$ and of different concentrations.

The workpiece rests on the upper edges of the weirs and hangs by its own weight between these upper edges to droop below the liquid level of the bath and thus pass through the bath. The treatment time in each bath is therefore dependent on the bath length, transport speed for the strip, and amount of droop of the strip between adjacent weirs. The droop is in turn a function of strip thickness, bendability, and tension.

It is quite difficult to get good results with this type of setup. If the strip is too stiff it will not hang down enough to enter the baths appreciably, so transport speed must be slowed enormously to compensate by increasing residence time in the bath. Similarly if the strip is too limp it will be etched excessively unless it is moves very rapidly or is tensioned considerably. If the strip hangs too loosely in the baths it can rub the walls or floor of the apparatus and wear these parts out. Since band tension will have to vary between about 3000 N and 60,000 N for the necessary adjustment, a 20:1 variation, it is necessary to provide complex tensioning equipment.

In order to achieve uniform treatment it is possible to provide in each bath upstream and downstream upper rollers above the liquid level and upstream and downstream lower rollers below the liquid level and between the upper rollers. The strip passes over the upstream upper roller, then down and under the two lower rollers, then up and over the downstream upper roller. Such an arrangement, however, is extremely troublesome to operate. The rollers are quickly damaged by the acid and worn by the strip deflected around it. In addition the strip is subjected to so-called semiplastic deformation which can degrade it. Finally considerable energy is lost to the deformation and wear caused by the back-and-forth passage of the strip through the apparatus.

It is known to provide the apparatus with upper partition portions which form with the tops of the respective weirs slots some 100 mm–150 mm high, that is parallel to workpiece thickness, through which the strip passes with considerable clearance. These slots can be coarsely adjusted to prevent splashing of the one bath into the next one. Nonetheless this arrangement still allows the strip to carry considerable liquid from one bath to the next downstream bath, so that any accurate chemical balance established in these baths is quickly destroyed.

OBJECTS OF THE INVENTION

It is therefore an object of the present invention to provide an improved metal-strip pickling apparatus.

Another object is the provision of such a metal-strip pickling apparatus which overcomes the above-given disadvantages.

A yet further object is to provide a simple apparatus which ensures effective treatment of the strip surfaces regardless of strip size and bendability, yet which is energy efficient.

Yet another object is to provide such an apparatus which prevents the various baths from becoming mixed with one another.

SUMMARY OF THE INVENTION

These objects are attained according to the instant invention in metal-strip pickling apparatus comprising feed means including upstream and downstream bridle-roller pairs for longitudinally displacing the strip under longitudinal tension along a straight transport path from the upstream bridle-roller pair to the downstream bridle-roller pair. A housing longitudinally traversed by the strip is subdivided longitudinally by a succession of transverse partitions into a longitudinal succession of compartments each having a respective treatment bath, normally of acid. Each partition has a rigid lower partition half having an upper edge and an upper partition half having a lower edge portion elastically engaging the upper face of the strip moving along the path. The upper edges all are longitudinally aligned and touch the lower face of the strip moving along the path.

According to this invention the acid baths have liquid levels above the upper edges of the respective lower partition halves. The lower portions of the upper partition halves seal tightly with the strip and respective lower partition halves. Thus liquid from one bath cannot pass between the respective partition halves into the next compartment so that the concentrations, compositions, and temperatures of the different baths can be individually controlled and maintained. The instant invention therefore allows the compartments to be filled with treatment liquid above the level of the strip in the compartment. As a result the strip, regardless of thickness or width, will be treated from the instant it enters a compartment until it leaves. The elastic lip or the like of the upper partition half prevents appreciable leakage between compartments also, so that the various baths do not rapidly contaminate each other. In addition the use of a straight transport path through the apparatus means that strip tension becomes irrelevant, so that no complex mechanism need be provided, as long as the strip does not droop in any compartment enough to touch its floor. According to this invention the strip is held taut enough to be virtually perfectly straight, this makes the path length in each compartment independent of tension, and reduces wear on the upper edges of the lower partition halves.

According to another feature of this invention each of the upper partition halves has an upper portion formed with a transverse and downwardly open groove. The lower portions are wholly elastic and having upper beads complementarily fitted in the respective grooves. Each of the lower portions can be formed of two flatly engaging strips and can be vertically slitted and thereby subdivided into a transverse succession of sections for best sealing action. In addition it is possible for the upper partition half to be entirely of an elastomer and to be provided internally with a transversely extending rigid stiffening element. Such construction is relatively simple and durable. An appropriate acid-resistant butyl can be used to make the upper partition halves or at least their lower portions for long service life.

The apparatus of this invention futher has at least one second partition identical to the first-mentioned partitions and subdividing one of the compartments into a treatment compartment containing the respective bath and a drain compartment and means for removing liquid from the drain compartment. Such a compartment is normally provided at the extreme upstream and downstream ends of the apparatus to catch any liquid leaking from the end compartments formed by the extreme upstream and downstream first partitions. In addition each such drain compartment can have a pair of pinch rollers defining a strip-pinching nip in the drain compartment for physically driving acid from the strip therein. When such a drain compartment is used between two compartments to effectively isolate them in a situation where mixing of the two baths must be reduced as much as possible, the intermediate drain compartment has a weir subdividing it into an upstream drain subcompartment and a downstream drain subcompartment.

The drain compartment can be at a longitudinal end of the compartment and have an end wall formed with a slot through which the workpiece passes and provided with a pair of flexible seals vertically embracing the strip. In this manner it is possible to segregate the baths very thoroughly from one another. The lower partition half at the extreme upstream and downstream ends of the housing are formed elastically as described above, and as mentioned all of the slots or openings through the partitions are linearly aligned.

It is also possible for the partitions not to seal elastically, but for each to have an upper portion, a hinge suspending the respective lower portion on the respective upper portion for pivoting about a horizontal and transverse axis, and spring means for pivotally urging the respective lower portion into snug contact with the upper face of the strip. This arrangement can use an acid-proof and rigid pivotal portion for exceedingly good resistance to wear. In addition this pivotal lower portion can be at least limitedly elastically deformable for best sealing with the top strip surface. The lower strip face naturally seals tightly against the upper edge of the lower partition half.

DESCRIPTION OF THE DRAWING

The above and other features and advantages will become more readily apparent from the following, reference being made to the accompanying drawing in which.

SPECIFIC DESCRIPTION

Figure 1:
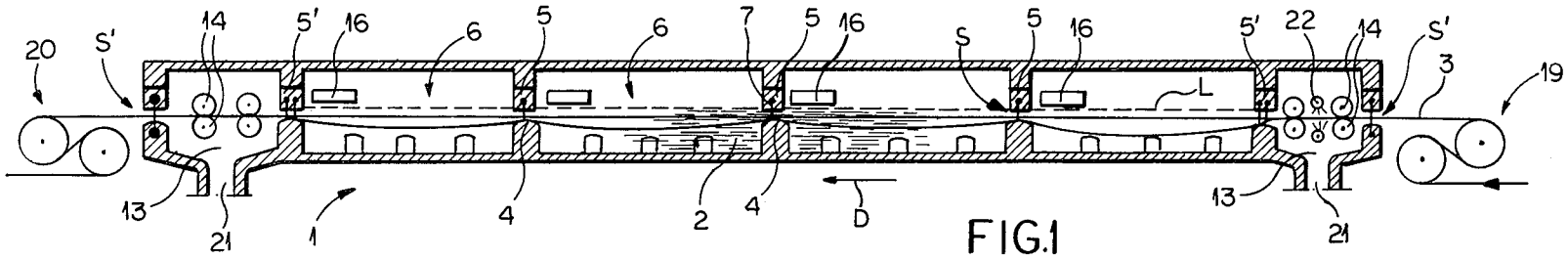
FIG. 1 is a partly schematic longitudinal section through the apparatus according to this invention.

As seen in FIGS. 1, 2, 4, and 5 an apparatus according to this invention has a housing 1 subdivided longitudinally by partitions 5 into a succession of compartments 6 having respective acid baths 2. The partitions 5 define longitudinally aligned slots S through which a steel strip 3 is pulled in a direction D between an upstream bridle-roller pair 19 and a downstream bridle-roller pair 20.

The housing 1 has extreme upstream and downstream compartments 13 that have drains 21 and that are each provided with a pair of pinch rollers 14. Thus any liquid on the workpiece at the start of the process and at the end of the process is eliminated. In addition the upstream-end drain compartment 13 has a sprayer 22 for liquid pretreatment of the strip, for instance with a detergent to eliminate any acid-blocking oil film from it.

Figure 4:
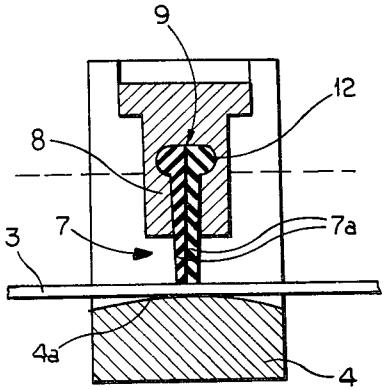

The compartments 6 can all be substantially identical. Each is defined, as described above, between a pair of partitions 5 forming horizontally elongated slots S perpendicular to the direction D. Each partition as better seen in FIGS. 4 and 5 has a lower half or portion 4 having an upwardly cylindrically arcuate upper surface 4*a* on which the strip 3 rides. This portion 4 is formed of the same rigid and wear-resistant material as the housing, for instance cast iron or steel-clad concrete. FIG. 4 shows how the strip 3 can be straight, and FIG. 5 how it can be curved; in both situations the strip 4 will lie and seal tightly on the horizontal transverse surface 4*a*.

In addition each partition has an upper part 8 whose lower portion 7 acts as a seal, being formed by a pair of elastically deformable strips 7*a*. The strips 7*a* have ridges or welts 12 at the upper edges of their oppositely directed faces. The upper portion 8 is complementarily formed with a generally T-shaped groove 9 receiving these welts 12 and the upper portions of the strips 7*a*. The lower edge of the part 8 is spaced above the upper edge of the lower portion 4 by a height h equal to at most 1.2 times the maximum workpiece thickness t encountered. The slots S' at the extreme upstream and downstream ends of the housing 1 are formed between two such seals 7 engaging up and down like lips against the workpiece 3.

When unstressed the extreme lower edges of the elastomeric strips 7*a* extend to a spacing from the underlying upper surface 4*a* that is at most equal to the minimum strip thickness expected to be encountered. Thus this seal 7 will bear elastically on the upper face of the strip 3 whose lower face is bearing on the upper face 4*a* of the lower partition half 4. In addition as seen in FIG. 2 the seals 7 each are vertically slotted from their lower edges as shown at 10. These slots 10 seal tightly, but permit limited sectional flexing of the seal 7 to accommodate strips 3 of different widths. The upper partition halves 8 of the partitions 5' at the upstream and downstream ends of the four compartments 6 each have two such seals 7 as seen in FIG. 1, which arrangement is necessary because there is considerable differential pressure at these locations.

The tight seal at the slots S according to this invention allows the compartments to be filled to a level L above the slots S. This means that the strip 3 is exposed to the treatment liquid of the bath 2 from the instant it enters each compartment 6 until it leaves. As a rule this system is operated with a taut strip 3 so that it bears minimally on the surfaces 4*a*. The result is the same length for the treatment path in each compartment 6 regardless of workpiece size or bendability. Tension can be set crudely to keep the workpiece taut simply by differentially driving the conveyor rollers 19 and 20. No complex tension-measuring and -adjusting equipment is needed, and the seals 7 are flexible enough to accommodate any normal strip width so that no adjustment mechanism for the slots S is needed.

The level L of the baths 2 is maintained by an overflow 16 at the downstream end of each compartment 6. In addition as seen in FIG. 3 a respective pump 17 and filter 18 are connected to this overflow and back to the respective compartments 6 at their upstream ends to replenish and clean the baths 2.

Figure 6:
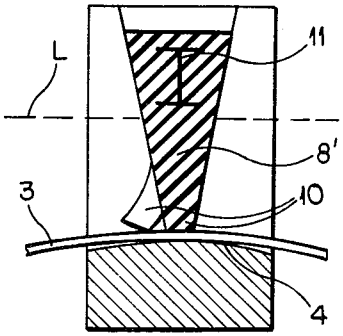
Figure 5:
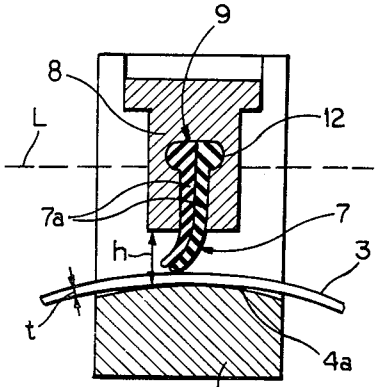
FIGS. 4 and 5 are large-scale longitudinal sections illustrating operation of this invention.
Figure 2:
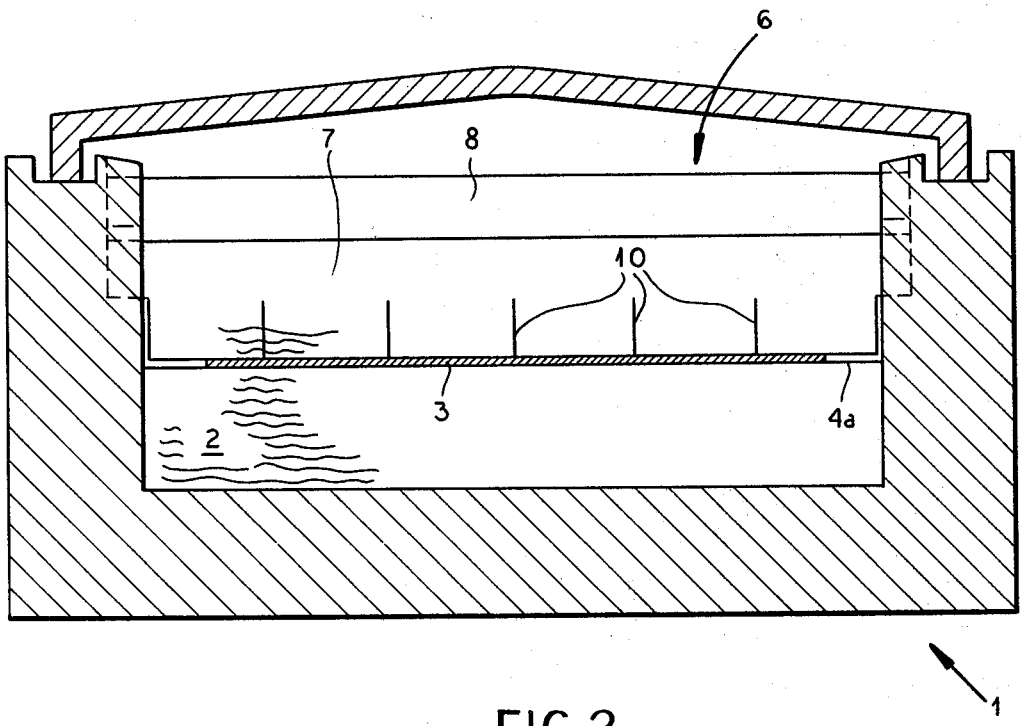
FIG. 2 is a large-scale cross section through the apparatus of this invention.
Figure 3:
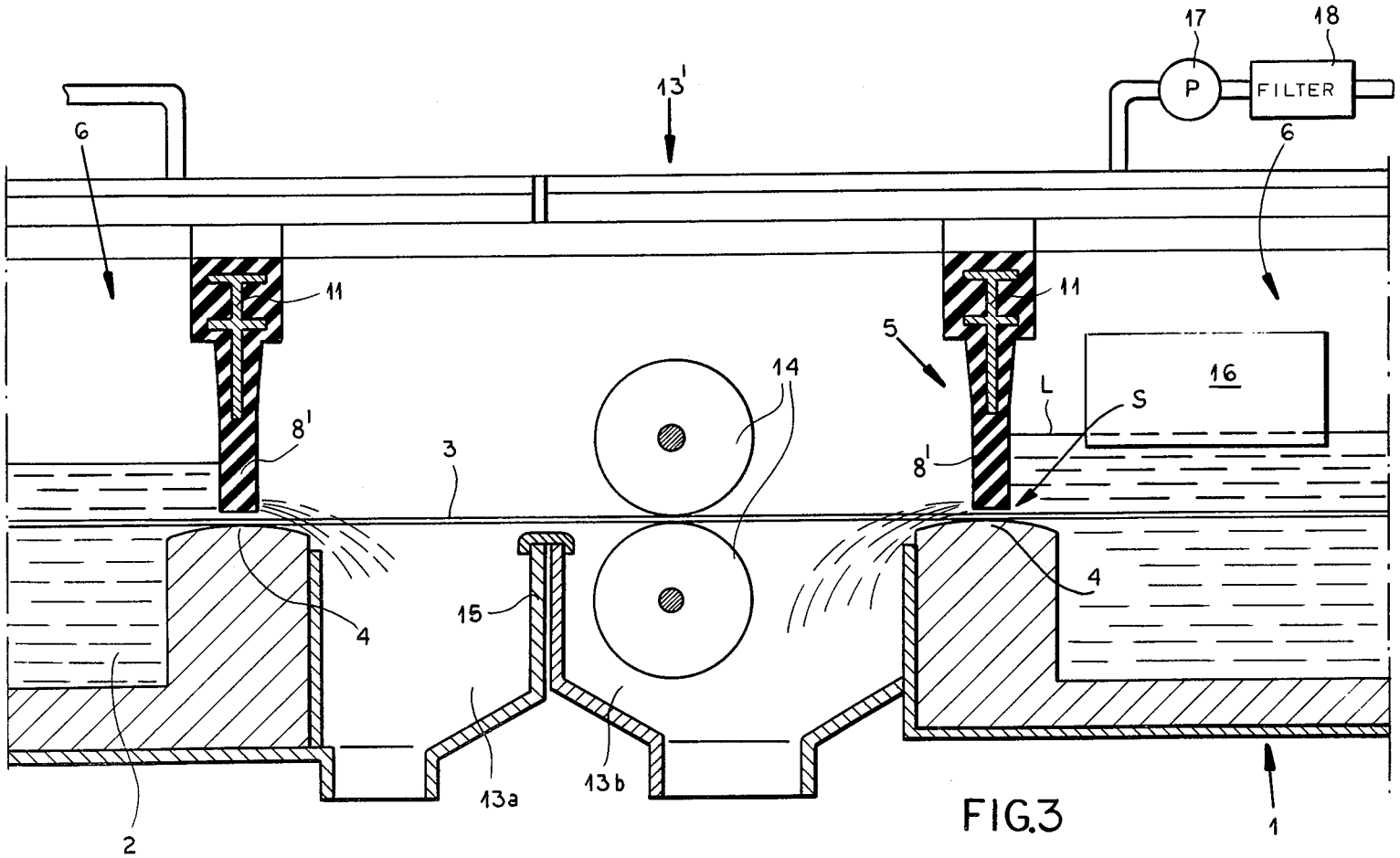
FIG. 3 is a large-scale longitudinal section through a detail of a variant of the invention.

FIG. 3 also shows an intermediate drain compartment 13' subdivided longitudinally by a weir 15 into two subcompartments **13*a* and 13*b* and provided between two normal bath compartments 6, not just at the apparatus ends as shown in FIG. 1. A set of pinch rollers 14 is provided in the upstream drain subcompartment 13*b* to clean the strip 3 of liquid from the upstream bath 2. In this arrangement and as shown in FIG. 6 the upper half of the partition is a single element 8' provided with a rigid reinforcing bar 11. The lower edge 10 of the massive partition 8' can deflect laterally as shown in FIG. 6**.

Figure 7:
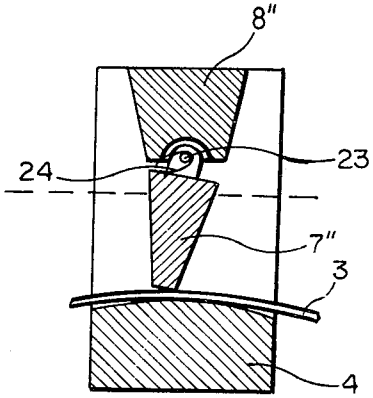
FIGS. 6 and 7 are views like FIGS. 4 and 5 showing further arrangements according to the invention.

FIG. 7 shows another arrangement comprising a rigid upper partition portion 8'' to which a rigid lower portion 7'' is hinged at 23. A torque spring 24 pivotally urges this flap portion 8'' upstream against the strip 8. The portion 7' can also be limitedly deformable, but of a stiffer elastomer than the strips **7*a***.

With the system of this invention it is possible to segregate the baths 2 very effectively, even though the respective compartments are filled above the entrance and exit slots. All the baths 2 are kept at the same level L to eliminate pressure differentials at the slots S and further prevent mixing. Where a pressure differential exists at a drain compartment 13 or 13', special precautions are taken, such as doubling the seal or providing separate drains.

We claim:

1. An apparatus for pickling a metal strip having a pair of opposite faces, the apparatus comprising:

feed means including upstream and downstream bridle-roller pairs for longitudinally displacing the strip under longitudinal tension along a straight transport path from the upstream bridle-roller pair to the downstream bridle-roller pair and with one of the strip faces directed upward and the other strip face directed downward;

a housing;

a succession of transverse partitions subdividing the housing longitudinally into a longitudinal succession of compartments, each partition having a rigid lower partition half having an upper edge, the upper edges all being longitudinally aligned and touching the lower face of the strip moving along the path, and an upper partition half having a flexible lower edge portion elastically engaging the upper face of the strip moving along the path; and respective acid baths in the compartments.

2. The strip-pickling apparatus defined in claim 1 wherein the acid baths have liquid levels above the upper edges of the respective lower partition halves, the lower portions of the upper partition halves sealing tightly with the strip and respective lower partition halves, whereby liquid from one bath cannot pass between the respective partition halves into the next compartment.

3. The strip-pickling apparatus defined in claim 2 wherein each of the upper partition halves has an upper portion formed with a transverse and downwardly open groove, the lower portions being wholly elastic and having upper beads complementarily fitted in the respective grooves.

4. The strip-pickling apparatus defined in claim 3 wherein each of the lower portions is vertically slitted and thereby subdivided into a transverse succession of sections.

5. The strip-pickling apparatus defined in claim 2 wherein the upper partition half is entirely of an elastomer and is provided internally with a transversely extending rigid stiffening element.

6. The strip-pickling apparatus defined in claim 2 wherein each of the upper partition halves has an upper portion formed with a transverse and downwardly open groove, the lower portions being wholly elastic, formed of at least two adjacent but separate elastomeric strips, and having upper beads complementarily fitted in the respective grooves.

7. The strip-pickling apparatus defined in claim 2 further comprising at least one second partition identical to the first-mentioned partitions and subdividing one of the compartments into a treatment compartment containing the respective bath and a drain compartment; and means for removing liquid from the drain compartment.

8. The strip-pickling apparatus defined in claim 7 further comprising a pair of pinch rollers defining a strip-pinching nip in the drain compartment for physically driving acid from the strip therein.

9. The strip-pickling apparatus defined in claim 7, further comprising a weir in the drain compartment subdividing same into an upstream drain subcompartment and a downstream drain subcompartment.

10. The strip-pickling apparatus defined in claim 7 wherein the drain compartment is at a longitudinal end of the compartment and has an end wall formed with a slot through which the workpiece passes and provided with a pair of flexible seals vertically embracing the strip.

11. The strip-pickling apparatus defined in claim 2, further comprising respective means for replenishing and filtering the baths.

12. The strip-pickling apparatus defined in claim 2 wherein each upper partition half has an upper portion;

a hinge suspending the respective lower portion on the respective upper portion for pivoting about a horizontal and transverse axis; and spring means for pivotally urging the respective lower portion into snug contact with the upper face of the strip.

13. An apparatus for pickling a metal strip having a pair of opposite faces, the apparatus comprising:

feed means including upstream and downstream bridle-roller pairs for longitudinally displacing the strip under longitudinal tension along a straight transport path from the upstream bridle-roller pair to the downstream bridle-roller pair and with one of the strip faces directed upward and the other strip face directed downward;

a housing;

a succession of transverse partitions subdividing the housing longitudinally into a longitudinal succession of compartments, each partition having a rigid lower partition half having an upper edge, the upper edges all being longitudinally aligned and touching the lower face of the strip moving along the path, the strip being supported on the upper edges, and an upper partition half having a flexible lower edge portion elastically engaging the upper face of the strip moving along the path; and respective liquid acid baths in the compartments having liquid levels above the upper edges of the lower partition halves and above the upper strip face, the partitions sealing tightly with the strip and thereby preventing liquid from one bath from passing to the adjacent bath.

* * * * *